US008424131B2

(12) United States Patent
Thomsen et al.

(10) Patent No.: US 8,424,131 B2
(45) Date of Patent: Apr. 23, 2013

(54) BASSINETS AND RELATED METHODS

(75) Inventors: Kevin S. Thomsen, Naperville, IL (US); Traci J. Barron, Saint John, IN (US); Marisa A. Williams, Berwyn, IL (US)

(73) Assignee: Kolcraft Enterprises, Inc., Chicago, IL (US)

( * ) Notice: Subject to any disclaimer, the term of this patent is extended or adjusted under 35 U.S.C. 154(b) by 202 days.

(21) Appl. No.: 12/940,308

(22) Filed: Nov. 5, 2010

(65) Prior Publication Data

US 2011/0113548 A1 May 19, 2011

Related U.S. Application Data

(60) Provisional application No. 61/261,127, filed on Nov. 13, 2009.

(51) Int. Cl.
*A47D 7/00* (2006.01)

(52) U.S. Cl.
USPC ..... 5/93.1; 5/98.1; 5/99.1

(58) Field of Classification Search ..... 5/93.1, 5/98.1, 99.1; 29/428
See application file for complete search history.

(56) References Cited

U.S. PATENT DOCUMENTS 5,553,336 A * 9/1996 Mariol ..... 5/93.1
6,131,218 A * 10/2000 Wang ..... 5/93.1
6,526,608 B1 * 3/2003 Hsia ..... 5/99.1
6,728,980 B1 * 5/2004 Chen ..... 5/93.1
2003/0177574 A1 * 9/2003 Waldman ..... 5/93.1
2004/0133977 A1 * 7/2004 Rimbau Vidal ..... 5/98.3
2005/0011004 A1 * 1/2005 Favorito (nee Wilkins) et al. ..... 5/94
2005/0210580 A1 * 9/2005 Clapper ..... 5/93.1
2005/0241064 A1 * 11/2005 Lopes et al. ..... 5/93.1
2006/0150323 A1 * 7/2006 Daeseleire ..... 5/93.1
2006/0236461 A1 * 10/2006 Ryan ..... 5/655
2007/0056097 A1 * 3/2007 Martin et al. ..... 5/93.1
2008/0229496 A1 * 9/2008 Wang ..... 5/93.1
2009/0049604 A1 * 2/2009 Chen et al. ..... 5/93.1
2009/0113625 A1 * 5/2009 Hutchinson et al. ..... 5/93.1
2012/0036634 A1 * 2/2012 Pacella ..... 5/93.1
2012/0037870 A1 * 2/2012 Fiore et al. ..... 5/93.1

* cited by examiner

*Primary Examiner* — Robert G Santos
*Assistant Examiner* — Brittany Wilson
(74) *Attorney, Agent, or Firm* — Hanley, Flight & Zimmerman, LLC

(57) ABSTRACT

Bassinet assemblies and related methods are disclosed. An example bassinet assembly includes an upper frame, a first support arm and a second support arm coupled to the upper frame and a floorboard coupled or adjacent to the first support arm and the second support arm. The example bassinet assembly also includes a support liner coupled between the floorboard and the upper frame and a cover disposed over at least a portion of each of the upper frame, the support liner and the floorboard.

23 Claims, 6 Drawing Sheets

BASSINETS AND RELATED METHODS

RELATED APPLICATION

This application claims the benefit of U.S. Provisional Patent Application Ser. No. 61/261,127, entitled "Bassinets and Methods of Assembling the Same," which was filed on Nov. 13, 2009, and is incorporated herein by reference in its entirety.

FIELD OF DISCLOSURE

This disclosure relates generally to child care products, and, more particularly, bassinets and methods of manufacturing and assembling child care products.

BACKGROUND

Childcare products such as bassinets typically have a frame, floor board and a soft goods encasing. With some known bassinets, the frame elements and/or the soft goods encasing may be structured in a manner that creates a pinch and/or entanglement risk for a child.

DETAILED DESCRIPTION

Figure 1:
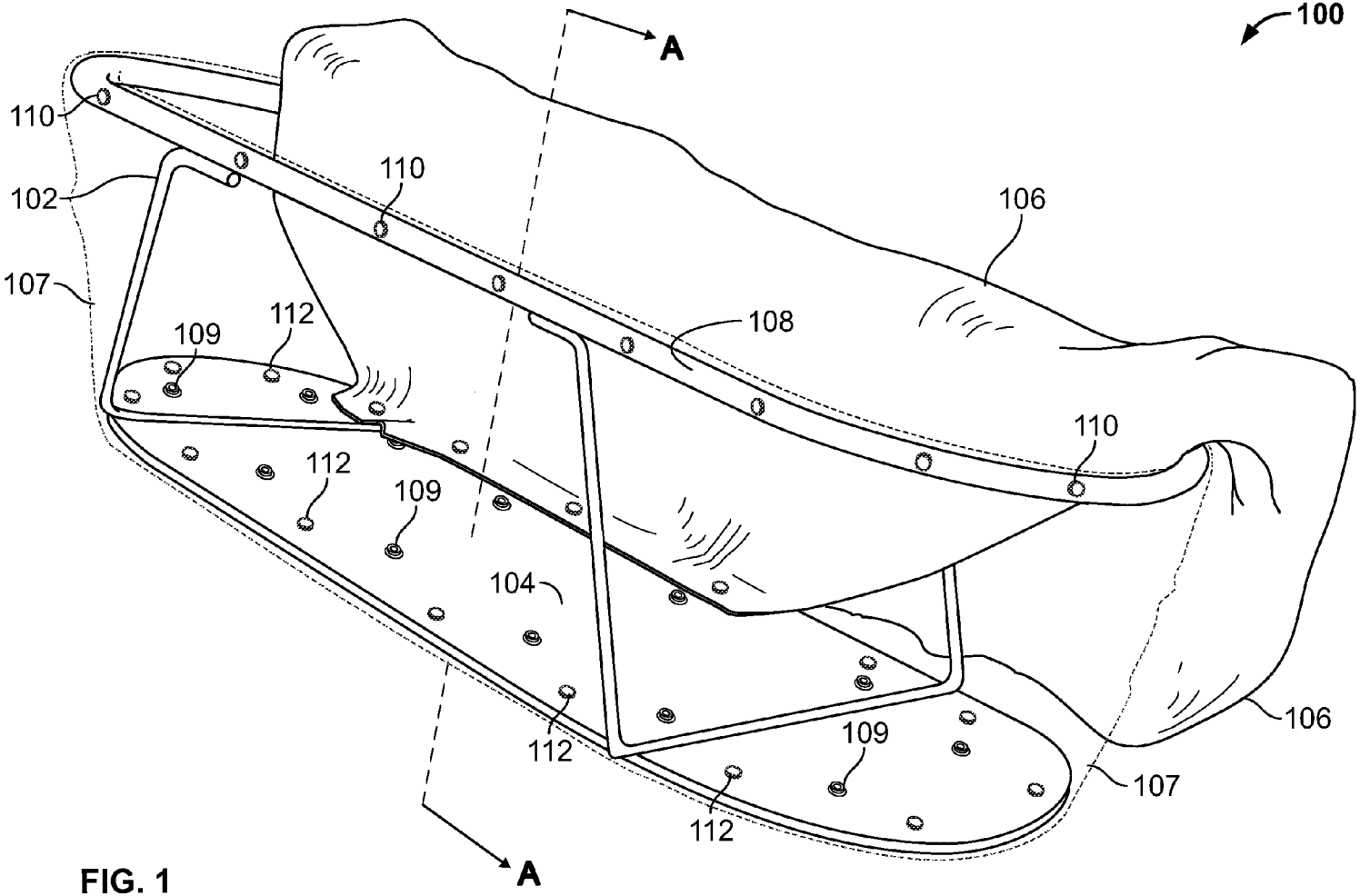
FIG. 1 depicts an example bassinet partially assembled with first example coupling mechanisms to couple a flexible support liner and a soft goods cover to a frame.

FIGS. 1—and 9 show example bassinets with example coupling mechanisms used to couple example flexible support liners and/or soft goods covers (e.g., the side walls of a bassinet) to example bassinets or other child care product frames.

An example bassinet assembly described herein includes an upper frame, a first support arm and a second support arm coupled to the upper frame and a floorboard coupled or adjacent to the first support arm and the second support arm. The example bassinet also includes a support liner coupled between the floorboard and the upper frame and a cover disposed over at least a portion of each of the upper frame, the support liner and the floorboard.

In some examples, the support liner is permanently coupled to the upper frame, and in some examples the cover is removably disposed over at least a portion of each of the upper frame, the support liner and the floorboard. In addition, as shown in the figures and described below, the example support liner, in some examples, has a first end and a second end and the first end is coupled to the upper frame and the second end is coupled to the floorboard. In other examples, the first end of the support liner is coupled to the upper frame across from the second end of the support liner. Furthermore, in some examples, the cover has a first end and a second end and the first end is coupled to the floorboard across from the second end.

In some of the examples described herein, the support liner and the cover wrap under the floorboard. Also, in some examples, the cover is coupled to an upper portion of the floorboard. The cover may also be coupled directly to the support liner.

The upper frame may include a plurality (e.g., two) rails that are coupled via swedging. The rails of the upper frame may also be locked together with a lock. In some examples, the upper frame is encapsulated in a sleeve formed in or coupled to the support liner.

An example bassinet assembly described herein involves a frame having an upper rail, a plurality of support arms or posts depending from the upper rail and a floorboard coupled or adjacent to the support arms. The example bassinet also includes a sidewall having a sidewall portion that is disposed between the upper frame and the floorboard. The sidewall includes a first layer and a second layer. In some examples, the first layer of the sidewall is permanently disposed between the upper frame and the floorboard and the second layer of the sidewall is removably disposed between the upper frame and the floorboard. Also, in some examples, the first layer has a first flexibility and the second layer has a second flexibility. The second flexibility is different, i.e., greater than or less than, the first flexibility.

The examples included herein also describe a method of manufacturing and/or assembling a bassinet assembly. An example method includes providing an upper frame and coupling a first support arm and a second support arm to the upper frame. The example method further includes providing a floorboard to be coupled to or placed adjacent to the first support arm and the second support arm and coupling a support liner coupled to the upper frame. Furthermore, the example method includes providing a cover to be disposed over at least a portion of each of the upper frame, the support liner and the floorboard.

In some example methods of manufacture and/or assembly, the support liner is permanently coupled to the upper frame. Also, in some example methods of manufacture and/or assembly, the cover is removably disposable over at least a portion of each of the upper frame, the support liner and the floorboard.

The methods of manufacture and/or assembly may also include coupling a first end of the support liner to the upper frame and coupling a second end of the support liner to the floorboard. Furthermore, the example methods may include coupling a first end of the support liner to the upper frame and coupling a second end of the support liner to the upper frame across from the first end. In some examples, the method includes wrapping the support liner under the floorboard. In addition, some of the examples described herein include forming the support liner into a sleeve and inserting the upper rail into the sleeve.

Turning now to the figures in detail, in FIG. 1, an example bassinet 100 is shown partially assembled. The example bassinet 100 includes a frame 102, which is coupled to a floorboard 104. The example bassinet 100 also includes a soft goods cover portion 106 that, when assembled, forms the sidewalls or portions of the sidewalls of the bassinet 100 and, in some examples, may also form a floor covering. The example bassinet also includes a liner 107 (shown in phantom) that also forms the sidewalls or portions of the sidewalls. The example bassinet 100 may also include a floor pad (not shown) that is disposed between the floorboard 104 and the soft goods cover 106 when assembled or inserted into a pocket (not shown) of the soft goods cover 106. The example frame 102 may be made of steel tubing or any other suitable material. The example floorboard 104 may be made of Masonite, foam board or any other suitable material. In addition, the soft goods cover 106 may be made of a fabric, flexible plastic, a mesh, or any other flexible and breathable material or combination thereof.

The example liner 107 of FIG. 1 is permanently coupled to the frame by fastening the liner 107 to an upper rail 108 of the frame 102 at one or more fastening points 110. By "permanent," this disclosure means that the "permanently" attached objects are not intended to be separated during the useful life of the product and, thus, are joined so as to make separation difficult or undesirable for the end user. Fasteners such as, for example, rivets, bolts, screws or any other suitable mechanical and/or chemical fastener(s) may be used to permanently fasten the liner 107 to the upper rail 108 of the bassinet 100. The floorboard 104 also includes a plurality of fastening points 112. Fasteners such as, for example rivets, bolts, screws or any other suitable mechanical and/or chemical fastener(s) may be used to permanently fasten the liner 107 to the floorboard 104 of the bassinet 100.

As described above, in the example shown in FIG. 1, the liner 107 is permanently coupled to the bassinet frame 102 and floorboard 104 and, therefore, the user of the bassinet 100 cannot easily disassemble the liner 107 from the bassinet 100. In contrast, the soft goods cover 106 is removably coupled to the frame and or floorboard via a plurality of fastening points 109 and/or as described below. The soft goods cover 106 can easily be removed by the user of the bassinet for purposes such as cleaning. Preferably, the structure of FIG. 1 is sold with the liner 107 fully assembled, thereby eliminating the possibility that the user misassembles the soft goods cover 106. Therefore, the risk that an infant could sustain serious or fatal injuries by falling out of or trapping its head in a misassembled or otherwise loose soft goods cover 106 if the user improperly assembles the soft goods cover 106 is reduced.

Figure 2:
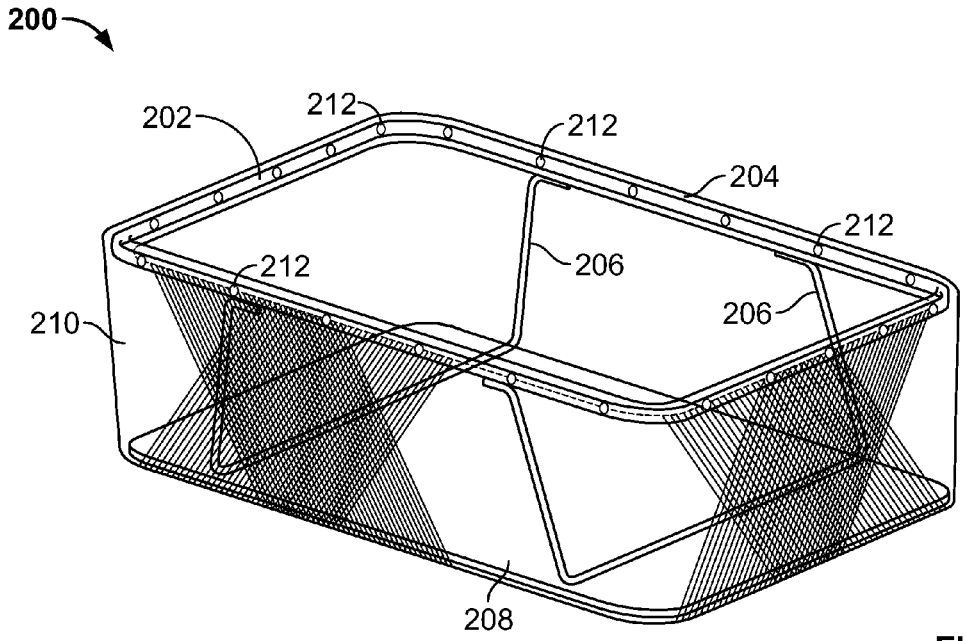
FIG. 2 depicts another example bassinet with an example flexible support liner coupled to a frame.
Figure 3:
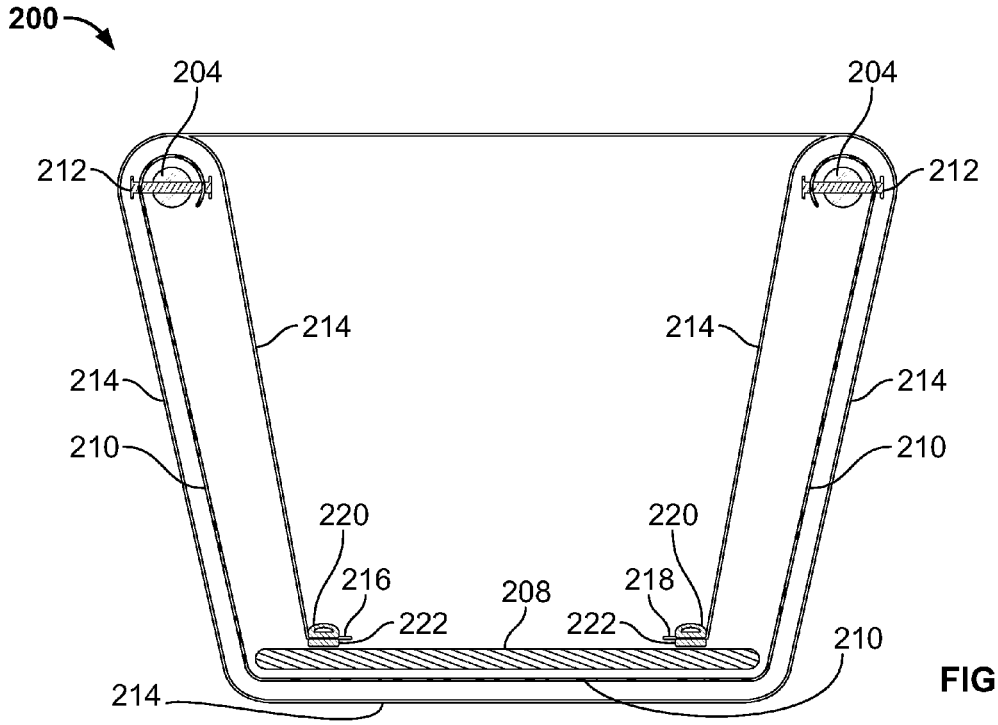
FIG. 3 is a cross-sectional view of the example bassinet of FIG. 2 with example soft goods.
Figure 4:
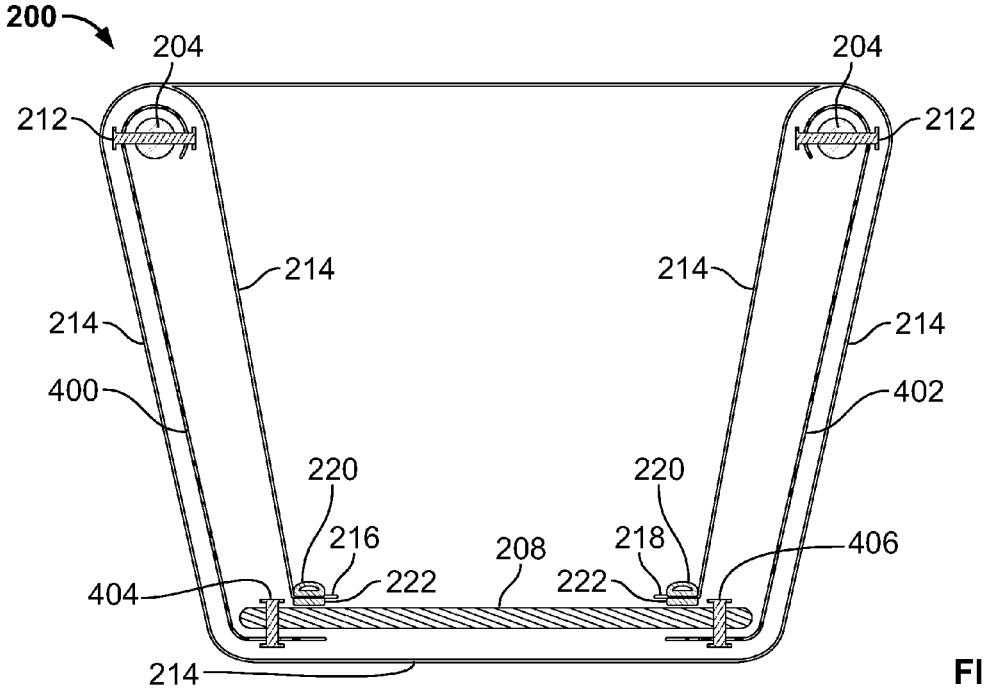
FIG. 4 is a cross-sectional view of the example bassinet of FIG. 2 with an alternative example flexible support liner and with a soft goods cover coupled to a frame.

In some instances a parent or other caretaker may want to remove the soft goods cover from a child care device such as, for example, a bassinet, to facilitate washing of the same. FIGS. 2-4 show an example bassinet 200 that is configured to include a removable soft goods cover 214 without compromising the safety features afforded by the example bassinet 100 of FIG. 1, namely, the reduction in the risk that a parent could misassemble the soft goods cover 214 or that a child could compromise the integrity of the coupling between the soft goods cover 214 and the bassinet frame assembly resulting in injury to the child.

The example bassinet 200 of FIG. 2 includes a frame 202 having an upper rail 204 and two pivotable support arms 206 that removably engage a floorboard 208. The floorboard 208 may be, for example, a rigid piece of particle board. The example bassinet 200 also includes a flexible support liner 210 that wraps under the floorboard 208 and is coupled to the upper rail 204 of the frame 202 at a plurality of fastening points 212. The example flexible support liner 210 may be coupled to the frame 202 at the fastening points 212 via any suitable mechanical and/or chemical fastener(s) (e.g., rivets) to permanently couple the flexible support liner 210 thereto. The example flexible support liner 210 may be a plastic, a fabric, a mesh or any other suitable material flexible and breathable material or combination thereof.

In this example, when it is desired to move the bassinet 200 from the use position shown in FIG. 2 to a collapsed position, the arms 206 may be pivoted upward and the upper rail 204 moved downward to collapse the basinet 200. During the transition from the use position to the collapsed position, the example flexible support liner 210 folds, crumples or is otherwise compressed.

FIG. 3 is a cross-sectional view of the example bassinet 200 shown in FIG. 2 but also showing example soft goods cover 214, which was not shown in FIG. 2. As shown in FIG. 3, the example flexible support liner 210 wraps under the floorboard 208 and is permanently coupled to the upper rail 204 at the fastening points 212 (shown here as rivets). The example soft goods cover 214 is coupled to one side of the floorboard 208 at a first releasable coupling point 216, is wrapped over the upper rail 204 and flexible support liner 210, under the floorboard 208 and flexible support liner 210, over the upper rail 204 and flexible support liner 210 on an opposite side of the bassinet 200 and to a second releasable coupling point 218. Thus, the soft goods cover 214 completely encapsulates one or more of the flexible support liner 210, the floorboard 208 and frame 202.

In this example, the releasable coupling points 216, 218 are disposed on opposite sides of the floorboard 208. The soft goods cover 214 includes a first fastener half 220 that engages a second fastener half 222 that is coupled to the floorboard 208. In this example, the first and second fastener halves 220, 222 are male and female portions of a snap connector. In other examples, the first and second fastener halves 220, 222 may be straps, ties, hook and loop fasteners (e.g., Velcro), clips or any other releasable mechanical releasable fastener(s). Furthermore, in some examples there are one or more additional releasable coupling points such as, for example, releasable coupling points disposed at locations around the perimeter of the floorboard 208 in a rectangular, oval, oblong and/or other configuration.

To remove the soft goods cover 214 from the bassinet 200, the user disengages the first and second fastener halves 220, 222 and unwraps the soft goods cover 214 from the bassinet 200. The soft goods cover 214 may then be laundered or otherwise cleaned and the flexible support liner 210 may be wiped down, if desired. Thus, the soft goods cover 214 provides a washable surface that is intended for direct exposure to an infant while the flexible support liner 210 provides a strong and secure soft frame to ensure the soft goods cover is not relied upon to provide mechanical support for the child.

FIG. 4 shows an alternative example in which the flexible support liner 210 of the prior example is replaced with a first flexible support liner 400 and a second flexible support liner 402. In this example, the first and second flexible support liners 400, 402 are coupled to the upper frame 204 in the same manner indicated above. However, instead of wrapping around the floorboard 208 and traversing the entire bottom of the floorboard 208, each of the first and second flexible support liners 400, 402 is coupled to the floorboard 208 on a respective side of the bassinet 200. Specifically, the first flexible support liner 400 is coupled to the bottom of the floorboard 208 via a first secondary fastening point 404 and the second flexible support liner 402 is coupled to the bottom of the floorboard 208 via a second secondary fastening point 406. In this alternative example, the first and second flexible support liners 400, 402 are coupled to the first and second secondary fastening points 404, 406, respectively, via rivets. However, in other examples, the first and second flexible support liners 400, 402 may be coupled to the first and second secondary fastening points 404, 406 via screws, pins or any other permanent mechanical and/or chemical fastener(s). In addition, in the example of FIG. 4, the soft goods cover 214 completely encapsulates the flexible support liners 400, 402.

In some examples, the first and second liners 400, 402 are a single integral piece of liner. In such examples, the liner is a single structure (e.g., of a rectangular shape) that wraps around the side of bassinet 200 and is coupled to the upper rails 204 and the floorboard 208 as described above.

Figure 5:
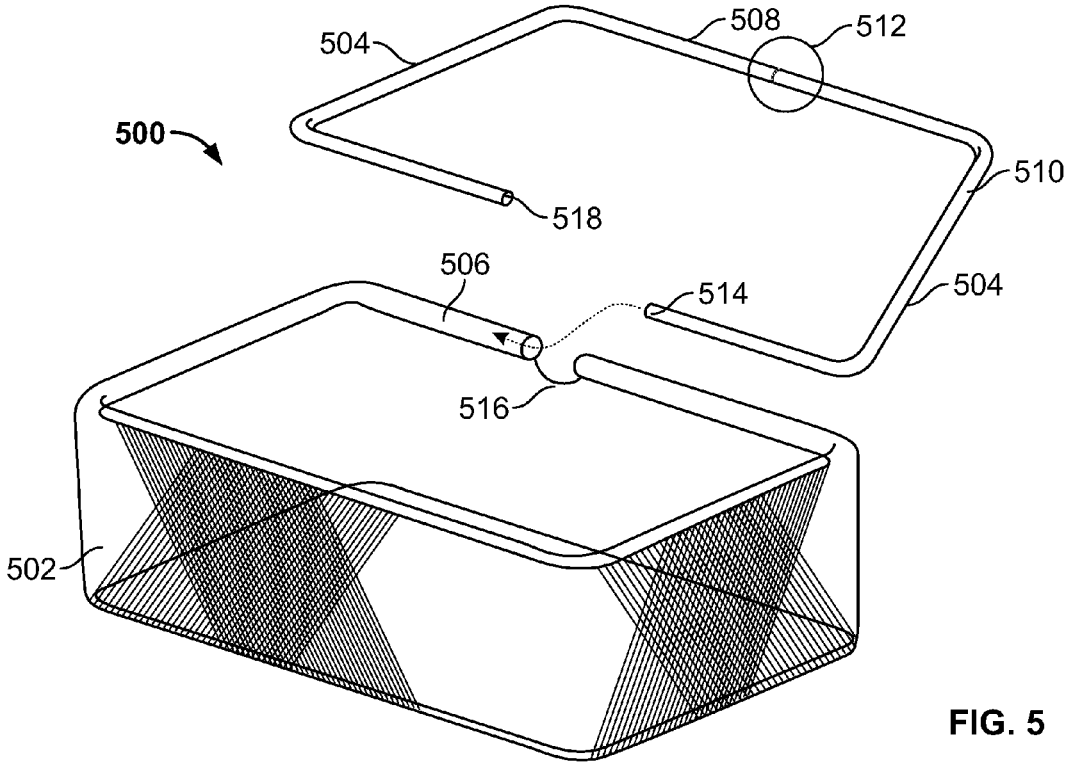
FIG. 5 is an exploded view of portions of yet another example bassinet with another example flexible support liner.

FIG. 5 illustrates another example bassinet 500 that includes an example flexible support liner 502 and an upper frame 504. In this example, the example flexible support liner 502 includes a loop or sleeve 506 at an upper end of the flexible support liner 502 that is integral with the flexible support liner 502. In other examples, the flexible support liner 502 may have a top end portion that is fastened to or threaded into a channel of a tube or sleeve that is not integral with the flexible support liner 502 to couple the flexible support liner 502 thereto.

Furthermore, the upper frame 504 includes a first upper frame rail 508 and a second upper frame rail 510 that are coupled (e.g., by swedging or press fitting ends of the first and second upper frame rails 508, 510) at first upper coupling point 512. A first end 514 of the upper frame 504 is inserted or threaded into an opening 516 of the sleeve 506 and wrapped through the sleeve 506 until the upper frame 504 is fully inserted into the sleeve 506, and the first end 514 and a second end 518 of the upper frame 504 are exposed in the opening 516 of the sleeve 506. In some examples, the sleeve 506 may include two or more openings along its perimeter.

Figure 6:
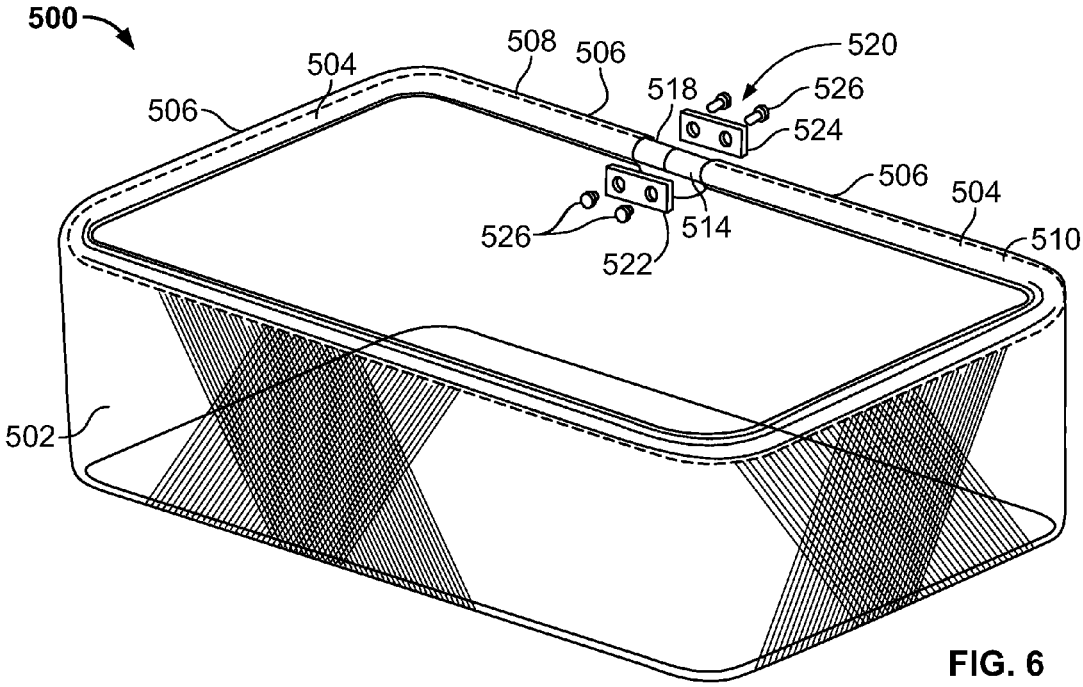
FIG. 6 is a partially assembled view of a portion of the example bassinet of FIG. 5.

The first and second ends 514, 518 of the upper frame 504 are coupled via any suitable mechanical and/or chemical fastener(s). For example, as shown in FIG. 6, the first and second ends 514, 518 of the upper frame 504 are coupled via a clamp or lock 520. The lock 520 includes a first lock half 522 and a second lock half 524 that are coupled via rivets 526 or any other suitable mechanical or chemical fastener(s). In some examples, the lock 520 is omitted and the tubes of the frame 504 are coupled directly to each other (e.g., via a rivet or any other suitable mechanical and/or chemical fastener(s)). Furthermore, in some examples, the lock 520 may include mounting for accessories such as, for example, electrical components that can provide vibrations, lights and/or music to entertain and/or pacify a child.

A floorboard similar to the floorboards 104, 208 described above may be inserted into the example bassinet 500 and/or slipped under, over or in the flexible support liner 502 of FIG. 5. Furthermore, a soft goods cover may be added to the bassinet 500 such as, for example, around the flexible support liner 502 as shown in FIG. 7.

Figure 7:
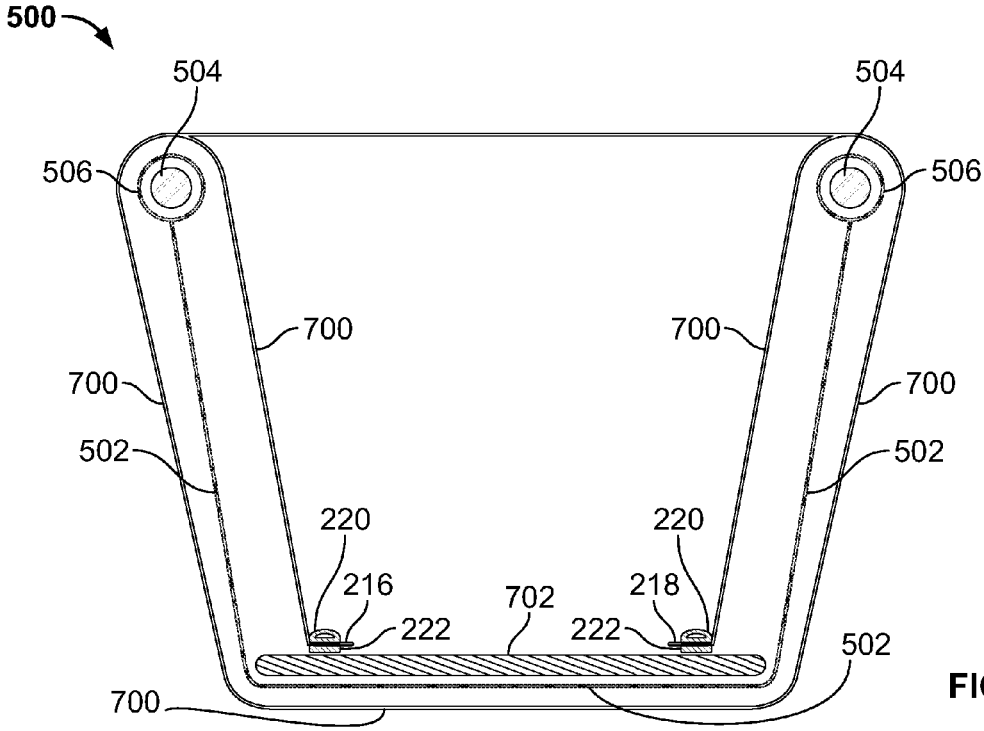
FIG. 7 is a cross-sectional view of the example bassinet of FIG. 5 when fully assembled with the soft goods cover coupled to the frame.

FIG. 7 is a cross-sectional view of the assembled bassinet 500 of FIGS. 5 and 6, but having a soft goods cover 700 and a floorboard 702 coupled thereto. In the example shown in FIG. 7, the soft goods cover 700 is coupled via releasable fasteners to the floorboard in a manner similar to that described above with respect to FIG. 3.

In another example (not shown), the flexible support liner 502 of FIG. 5 may be split into two or more flexible support liners and coupled to the floorboard 702 of FIG. 7 in a manner similar to the coupling of the flexible support liners 400, 402 of FIG. 4.

Figure 8:
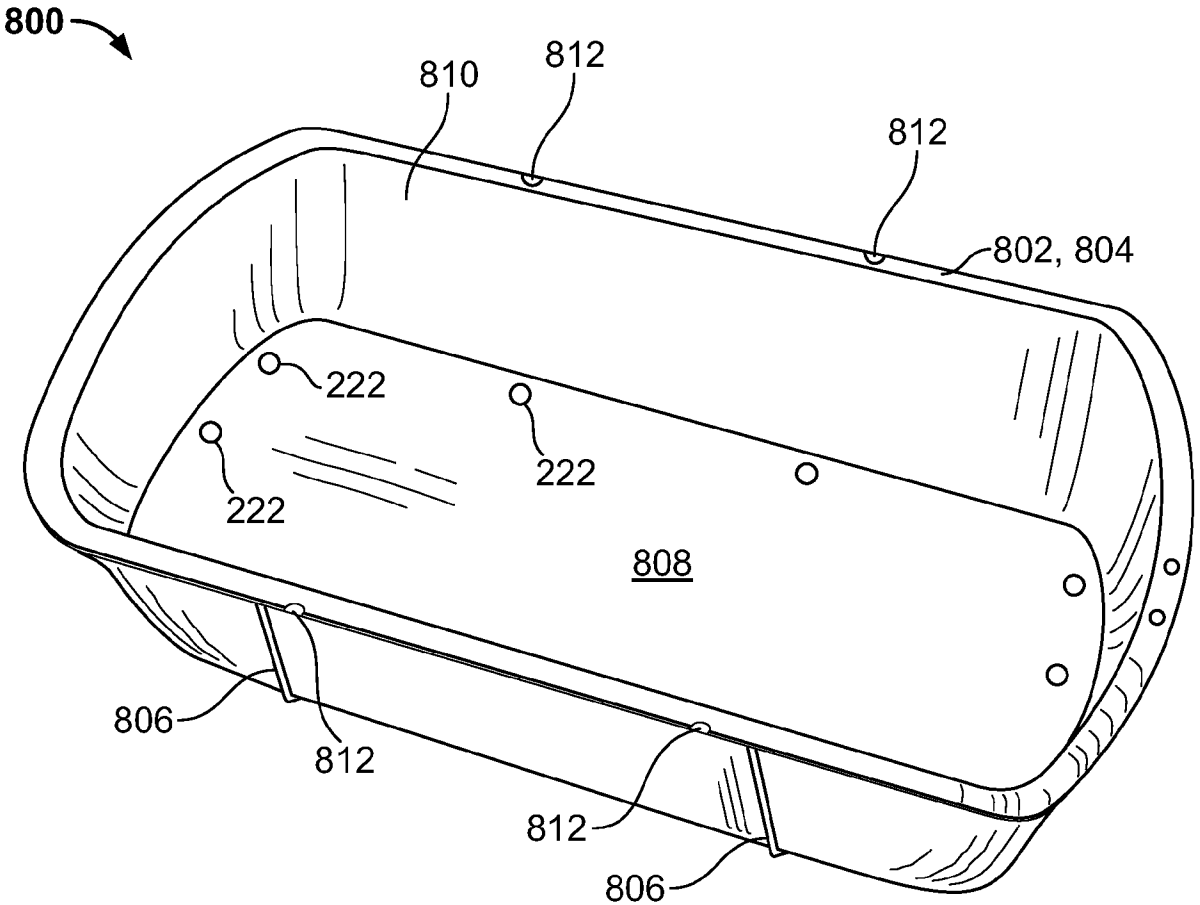
FIG. 8 depicts another example bassinet with an example flexible support liner coupled to a frame.

FIG. 8 shows an alternative example bassinet 800 that includes a frame 802 having an upper rail 804 and two support arms 806 that may be pivotable and that support a floorboard 808. The floorboard 808 may be, for example, a rigid piece of particle board, as described above and may include a padded surface. The example bassinet 800 also includes a flexible support liner 810 that wraps under the floorboard 808 between the arms 806 and the floorboard 808. The flexible support liner 810 is coupled to the upper rail 804 of the frame 802 at a plurality of fastening points 812. The example flexible support liner 810 may be coupled to the frame 802 at the fastening points 812 via any suitable mechanical and/or chemical fastener(s) (e.g., rivets) to permanently couple the flexible support liner 810 thereto. The example flexible support liner 810 may be made of a plastic, a fabric, a mesh or any other suitable material flexible and breathable material or combination thereof, as described above. The arms 806 are coupled to the upper frame 804 through the liner 810 or adjacent to an edge of the liner 810. The floor board 808 may be fastened to a lower bassinet frame (not shown) via bolts/nuts or any other suitable fasteners to form an elevated bassinet structure.

A soft goods cover such as, for example, any of the soft goods covers described herein, may be disposed over the liner 810, upper frame 804 and floorboard 808. The soft goods cover may be releasably couplable to the floorboard 808 via one or more of a plurality of releasable fasteners such as, for example, the fasteners 216, 218, 220, 222 described above.

In this example, when it is desired to move the bassinet 800 from the use position shown in FIG. 8 to a collapsed position, the soft goods cover and the floorboard 908 are removed, and the arms 806 are pivoted upward and/or the upper rail 804 moved downward to collapse the basinet 800. During the transition from the use position to the collapsed position, the example flexible support liner 810 folds, crumples or is otherwise compressed.

Figure 9:
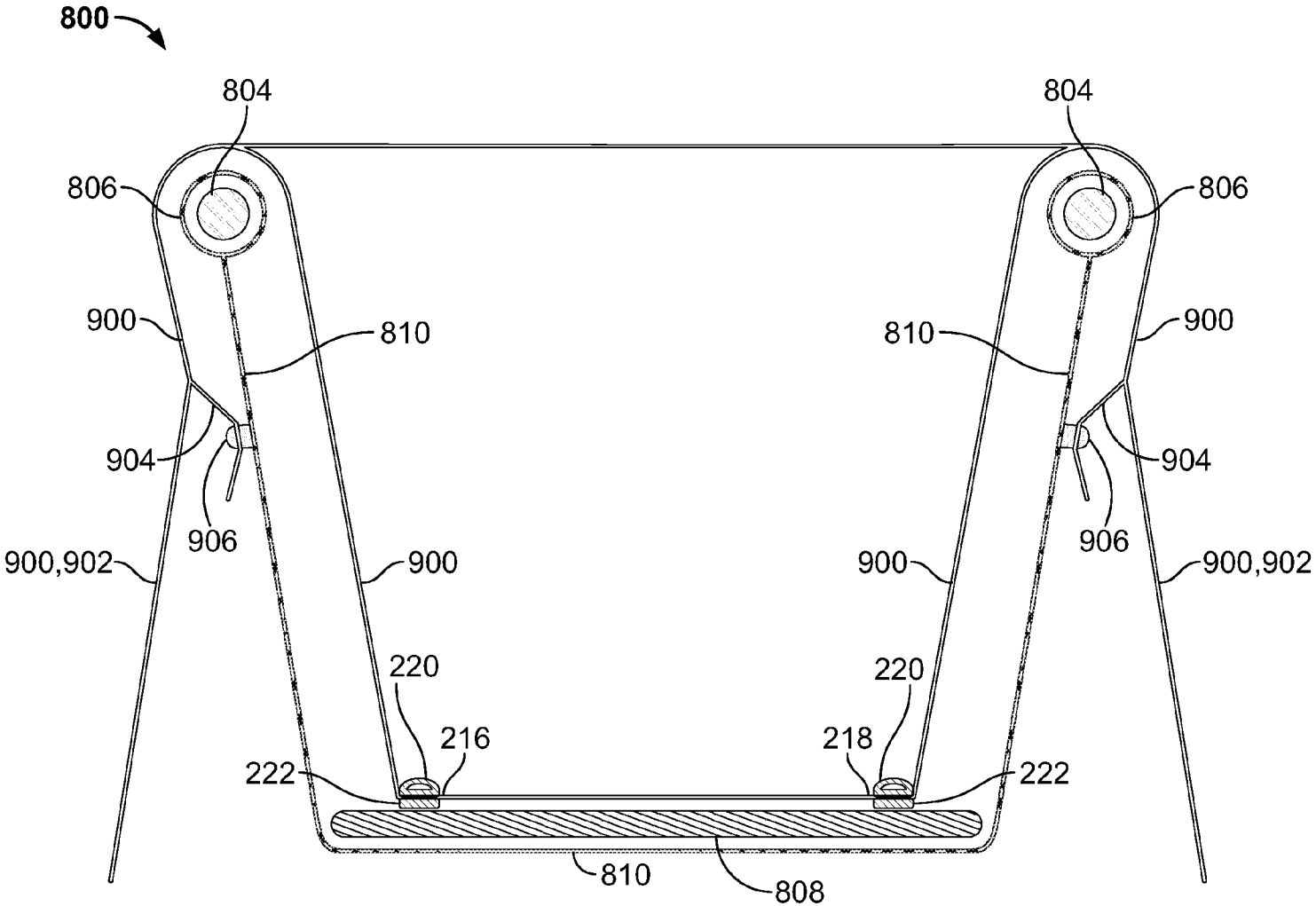
FIG. 9. is a cross sectional view of the example bassinet of FIG. 8 with an alternative example flexible support liner and with a soft goods cover coupled to a frame.

FIG. 9 is a cross-sectional view of the assembled bassinet 800 of FIG. 8 that includes a soft goods cover 900 that covers the upper frame 804 and the support liner 810. In particular, the example soft goods cover 900 covers the floorboard 808 and is coupled thereto via releasable fasteners in a manner similar to that described above. The releasable fasteners 216, 218, 220, 222 may be on the underside of the soft goods cover 900 and, thus, out of the reach of a child occupant, or the releasable fasteners 216, 218, 220, 222 may extend through the soft goods cover 900 to couple the soft goods cover 900 to the floorboard 808.

The soft goods cover 900 extends from the floorboard 808 over the support liner 810 at an interior side of the support liner 810, i.e., toward the interior of the bassinet 800, to the upper frame 804. The soft goods cover 900 continues past the upper frame 804 and down over the support liner 810 at an exterior side of the support liner 810, i.e., away from the interior of the bassinet 800. The soft goods cover 900 is coupled to or integral with a skirt 902. The soft goods cover 900 is also permanently, integrally or removably coupled to an extension 904 such as, for example, an extension strap. The extension 904 couples the soft goods cover 900 to the support liner 810 via, for example, a releasable fastener 906 such as, for example, any suitable fastener described herein or any other suitable releasable mechanical or chemical fastener.

The examples described herein reduce or eliminate the risks of a user misassembling the example bassinet or of a child compromising the integrity of the walls and/or floor components of the example bassinet, thereby reducing or eliminating the possibility of a child falling from the bassinet or getting its head stuck in a position with respect to loose or misassembled components. From the foregoing, persons of ordinary skill in the art will appreciate that bassinets with soft goods cover(s) and/or flexible support liner(s) and methods of assembling the same have been disclosed. Furthermore, the descriptions of each example described herein are not meant to be limiting to the specific example. All features of all examples may be substitute for and/or combined with other features of other examples. In addition, although the disclosure has focused on a bassinet, the teachings of this disclosure are applicable to other child care products such as bouncers, swing seats, cribs, high chairs, portable playards, portable bassinets for support within playards, changing tables, etc.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A bassinet assembly comprising:

an upper frame;

a first support arm and a second support arm coupled to the upper frame;

a floorboard coupled or adjacent to the first support arm and the second support arm;

a support liner coupled between the floorboard and the upper frame; and a cover disposed over at least a portion of each of the upper frame, the support liner and the floorboard, the cover being coupled to an upper portion of the floorboard.

2. A bassinet assembly as defined in claim 1, wherein the support liner is permanently coupled to the upper frame.

3. A bassinet assembly as defined in claim 1, wherein the cover is removably disposed over at least the portion of each of the upper frame, the support liner and the floorboard.

4. A bassinet assembly as defined in claim 1, wherein the support liner has a first end and a second end and the first end is coupled to the upper frame and the second end is coupled to the floorboard.

5. A bassinet assembly as defined in claim 1, wherein the cover has a first end and a second end and the first end is coupled to the floorboard across from the second end.

6. A bassinet assembly as defined in claim 1, wherein the support liner has a first end and a second end and the first end is coupled to the upper frame across from the second end.

7. A bassinet assembly as defined in claim 1, wherein the support liner wraps under the floorboard.

8. A bassinet assembly as defined in claim 1, wherein the cover wraps under the floorboard.

9. A bassinet assembly as defined in claim 1, wherein the cover is coupled directly to the support liner.

10. A bassinet assembly as defined in claim 1, wherein the upper frame includes a first rail and a second rail and the first rail and the second rail are coupled via swedging.

11. A bassinet assembly as defined in claim 1, wherein the upper frame includes a first rail and a second rail and the first rail and the second rail are coupled via a lock.

12. A bassinet assembly as defined in claim 1, wherein the support liner forms a sleeve to encapsulate the upper frame.

13. A bassinet assembly comprising:

a frame including an upper rail;

a plurality of support arms depending from the upper rail;

a floorboard coupled or adjacent to the support arms; and a sidewall having a sidewall portion that is disposed between the upper frame and the floorboard, wherein the sidewall includes a first layer and a second layer, the second layer coupled to an upper portion of the floorboard.

14. A bassinet assembly as defined in claim 13, wherein the first layer of the sidewall is permanently disposed between the upper frame and the floorboard and the second layer of the sidewall is removably disposed between the upper frame and the floorboard.

15. A bassinet assembly as defined in claim 13, wherein the first layer has a first flexibility and the second layer has a second flexibility, the second flexibility being different than the first flexibility.

16. A bassinet assembly as defined in claim 15, wherein the second flexibility is greater than the first flexibility.

17. A method of manufacturing a bassinet assembly, the method comprising:

providing an upper frame;

coupling a first support arm and a second support arm to the upper frame;

providing a floorboard to be coupled to or placed adjacent to the first support arm and the second support arm;

coupling a support liner to the upper frame; and providing a cover to be disposed over at least a portion of each of the upper frame, the support liner and the floorboard, the cover is to be coupled to an upper portion of the floorboard.

18. A method as defined in claim 17, wherein the support liner is permanently coupled to the upper frame.

19. A method as defined in claim 17, wherein the cover is removably disposable over at least a portion of each of the upper frame, the support liner and the floorboard.

20. A method as defined in claim 17 further comprising:

coupling a first end of the support liner to the upper frame; and coupling a second end of the support liner to the floorboard.

21. A method as defined in claim 17 further comprising:

coupling a first end of the support liner to the upper frame; and coupling a second end of the support liner to the upper frame across from the first end.

22. A method as defined in claim 17 further comprising wrapping the support liner under the floorboard.

23. A method as defined in claim 17 further comprising:

forming the support liner into a sleeve; and inserting the upper rail into the sleeve.

* * * * *